US006598495B2

(12) United States Patent
Elgart

(10) Patent No.: US 6,598,495 B2
(45) Date of Patent: Jul. 29, 2003

(54) PLASTIC ADJUSTABLE ACCELERATOR PEDAL WITH INTERNAL DRIVE MECHANISM

(75) Inventor: David Allen Elgart, Marlette, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 09/899,898

(22) Filed: Jul. 6, 2001

(65) Prior Publication Data

US 2003/0005791 A1 Jan. 9, 2003

(51) Int. Cl.[7] ..... G05G 1/14
(52) U.S. Cl. ..... 74/513; 74/512; 74/560
(58) Field of Search ..... 74/512, 560, 513

(56) References Cited

U.S. PATENT DOCUMENTS

| | | | | | |
|---|---|---|---|---|---|
| 3,643,525 | A | * | 2/1972 | Gibas | 74/512 |
| 3,691,868 | A | * | 9/1972 | Smith | 74/512 |
| 5,460,061 | A | * | 10/1995 | Redding et al. | 74/512 |
| 6,352,007 | B1 | * | 3/2002 | Zhang et al. | 74/512 |
| 6,407,526 | B1 | * | 6/2002 | Black et al. | 74/473.16 |
| 6,453,767 | B1 | * | 9/2002 | Willemsen et al. | 74/512 |

* cited by examiner

*Primary Examiner*—Chong H. Kim

(74) *Attorney, Agent, or Firm*—Casimir R. Kiczek; Richard M. Mescher

(57) ABSTRACT

An adjustable control pedal includes a molded-plastic upper support forming a hollow interior space. The upper support has a pair opposed side walls partially forming the interior space and opposed flanges inwardly extending into the interior space from the side walls. The opposed flanges are molded-in flanges unitary with the upper support. A pedal arm has a lower end carrying a pedal and an upper end provided with at least one guide pin slidingly supported by the opposed flanges for selected movement of the pedal arm relative to said upper support. The interior space is entirely enclosed by the upper support except for an opening at a bottom side of the upper support and the upper end of the pedal arm extends into the interior space through the opening. A drive assembly is operatively connected to the pedal arm to selectively move the lower arm relative to the upper support. The drive assembly includes a drive screw supported for rotational motion within the interior space of the upper support, a gear mechanism located within the interior space and operatively connected to the drive screw for rotating the drive screw, and a drive nut adapted for axial movement along the drive screw within the interior space in response to rotational motion of the drive screw. The upper support includes unitary molded-in journals supporting components of gear mechanism. The drive nut is operatively connected to the pedal arm to axially move the pedal arm along the drive screw with the drive nut as the drive screw rotates.

19 Claims, 6 Drawing Sheets

PLASTIC ADJUSTABLE ACCELERATOR PEDAL WITH INTERNAL DRIVE MECHANISM

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. For example, U.S. Pat. Nos. 5,632,183, 5,697,260, 5,722,302, 5,819,593, 5,937,707, and 5,964,125, the disclosures of which are expressly incorporated herein in their entirety by reference, each disclose an adjustable control pedal assembly. These control pedal assemblies include a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While these control pedal assemblies may adequately adjust the position of the control pedal to accommodate drivers of various size, these control pedal assemblies are relatively complex and expensive to produce. The relatively high cost is particularly due to the quantity of high-precision machined parts such as, for example, the guide tube and due to the quantity of welded joints.

U.S. Pat. Nos. 3,643,525 and 3,643,524, the disclosures of which are expressly incorporated herein in their entirety by reference, disclose adjustable control pedal assemblies which are much less expensive to produce. These control pedal assemblies include an upper arm having a horizontal slot, a rotatable screw shaft attached to the upper arm and extending along the slot, a nut in threaded engagement with the screw shaft and having a pin slidable within the slot, and a control pedal rigidly connected to the nut. The control pedal is moved forward and rearward when an electric motor rotates the screw shaft to translate the nut along the screw shaft. While these control pedal assemblies may adequately adjust the position of the control pedal to accommodate drivers of various size and are inexpensive to produce relative to the previously described assemblies, these control pedal assemblies require a relatively large amount of space and there is a never ending desire to reduce the production costs.

Additionally, each of the control pedal assemblies may be prone to operational problems due to contamination be dust and/or other foreign material or members interfering with the drive components. Accordingly, there is a need in the art for an improved adjustable control pedal assembly which selectively adjusts the position of the pedal to accommodate drivers of various size, is relatively simple and inexpensive to produce, and is highly reliable to operate.

SUMMARY OF THE INVENTION

The present invention provides a control pedal assembly which overcomes at least some of the above-noted problems of the related art. According to the present invention, an adjustable control pedal includes, in combination, an upper support forming a hollow interior space and a pedal arm having a lower end carrying a pedal. The pedal arm has an upper end extending into the interior space and supported by the upper support within the interior space for selected movement relative to the upper support. A drive assembly is operatively connected to the pedal arm to selectively move the lower arm relative to the upper support. The drive assembly includes a drive screw supported for rotational motion within the interior space of the upper support and a drive nut adapted for axial movement along the drive nut in response to rotational motion of the drive screw. The drive nut is operatively connected to the pedal arm to axially move the pedal arm along the drive screw with the drive nut upon rotation of the drive screw.

According to another aspect of the present invention, an adjustable control pedal includes an upper support forming a hollow interior space. The upper support has a pair opposed side walls partially forming the interior space and opposed flanges inwardly extending into the interior space from the side walls. A pedal arm has a lower end carrying a pedal and an upper end provided with at least one guide pin slidingly supported by the opposed flanges for selected movement of the pedal arm relative to the upper support. A drive assembly is operatively connected to the pedal arm to selectively move the lower arm relative to the upper support. The drive assembly includes a drive screw supported for rotational motion within the interior space of the upper support and a drive nut adapted for axial movement along the drive screw within the interior space in response to rotational motion of the drive screw. The drive nut is operatively connected to the pedal arm to axially move the pedal arm along the drive screw with the drive nut upon rotation of the drive screw.

According to yet another aspect of the present invention, an adjustable control pedal includes a molded-plastic upper support forming a hollow interior space. The upper support has a pair opposed side walls partially forming the interior space and opposed flanges inwardly extending into the interior space from the side walls. The flanges are molded-in flanges unitary with the upper support. A pedal arm has a lower end carrying a pedal and an upper end provided with at least one guide pin slidingly supported by the opposed flanges for selected movement of the pedal arm relative to said upper support. A drive assembly is operatively connected to the pedal arm to selectively move the lower arm relative to the upper support. The drive assembly includes a drive screw supported for rotational motion within the interior space of the upper support, a gear mechanism located within the interior space and operatively connected to the drive screw for rotating the drive screw, and a drive nut adapted for axial movement along the drive screw within the interior space in response to rotational motion of the drive screw. The upper support includes unitary molded-in journals supporting the gear mechanism. The drive nut is operatively connected to the pedal arm to axially move the pedal arm along the drive screw with the drive nut upon rotation of the drive screw.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, light weight, reliable, low cost assembly which is compact and contamination resistant. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
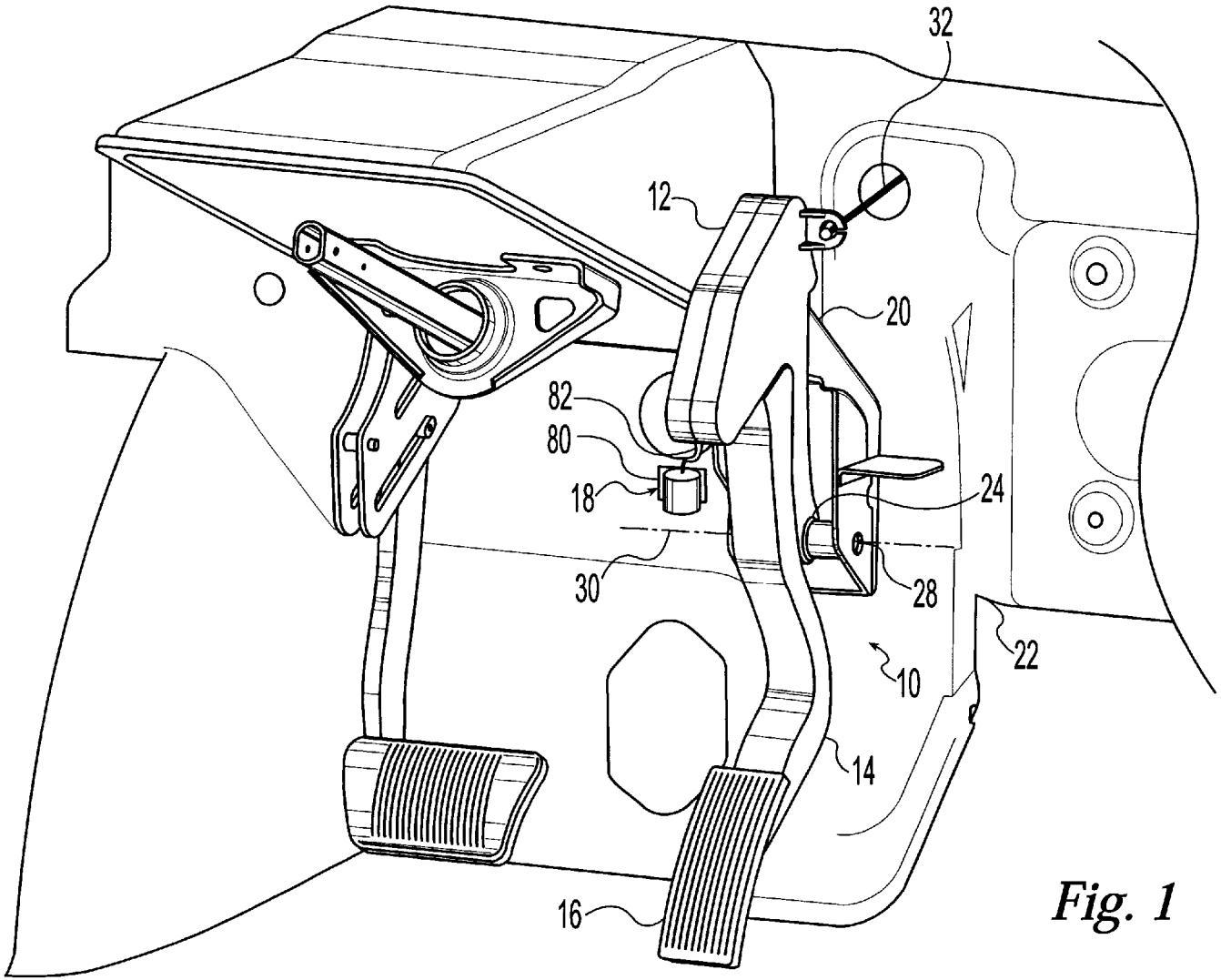
FIG. 1 is a perspective view of a portion of a motor vehicle cockpit having an adjustable control pedal assembly according to the present, wherein some components are removed for clarity.

It should be understood that the appended drawings are not necessarily to scale, presenting a somewhat simplified representation of various preferred features illustrative of the basic principles of the invention. The specific design features of an adjustable control pedal assembly as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the adjustable control pedal assembly illustrated in the drawings. In general, up or upward refers to an upward direction within the plane of the paper in FIG. 1 and down or downward refers to a downward direction within the plane of the paper in FIG. 1. Also in general, fore or forward refers to a direction toward the front of the vehicle and aft or rearward refers to a direction toward the rear of the vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedal 10 disclosed herein. The following detailed discussion of various alternative and preferred embodiments will illustrate the general principles of the invention with reference to an adjustable control pedal 10 for use with a motor vehicle. Other embodiments suitable for other applications will be apparent to those skilled in the art given the benefit of this disclosure.

Referring now to the drawings, FIG. 1 shows an adjustable control pedal 10 for a motor vehicle, such as an automobile, according to a preferred embodiment of the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles. While the illustrated adjustable control pedal 10 is adapted as a throttle-control or accelerator pedal but it is noted that adjustable control pedal 10 can alternatively be adapted as a brake, clutch, or other desired pedal within the scope of the present invention.

Figure 2:
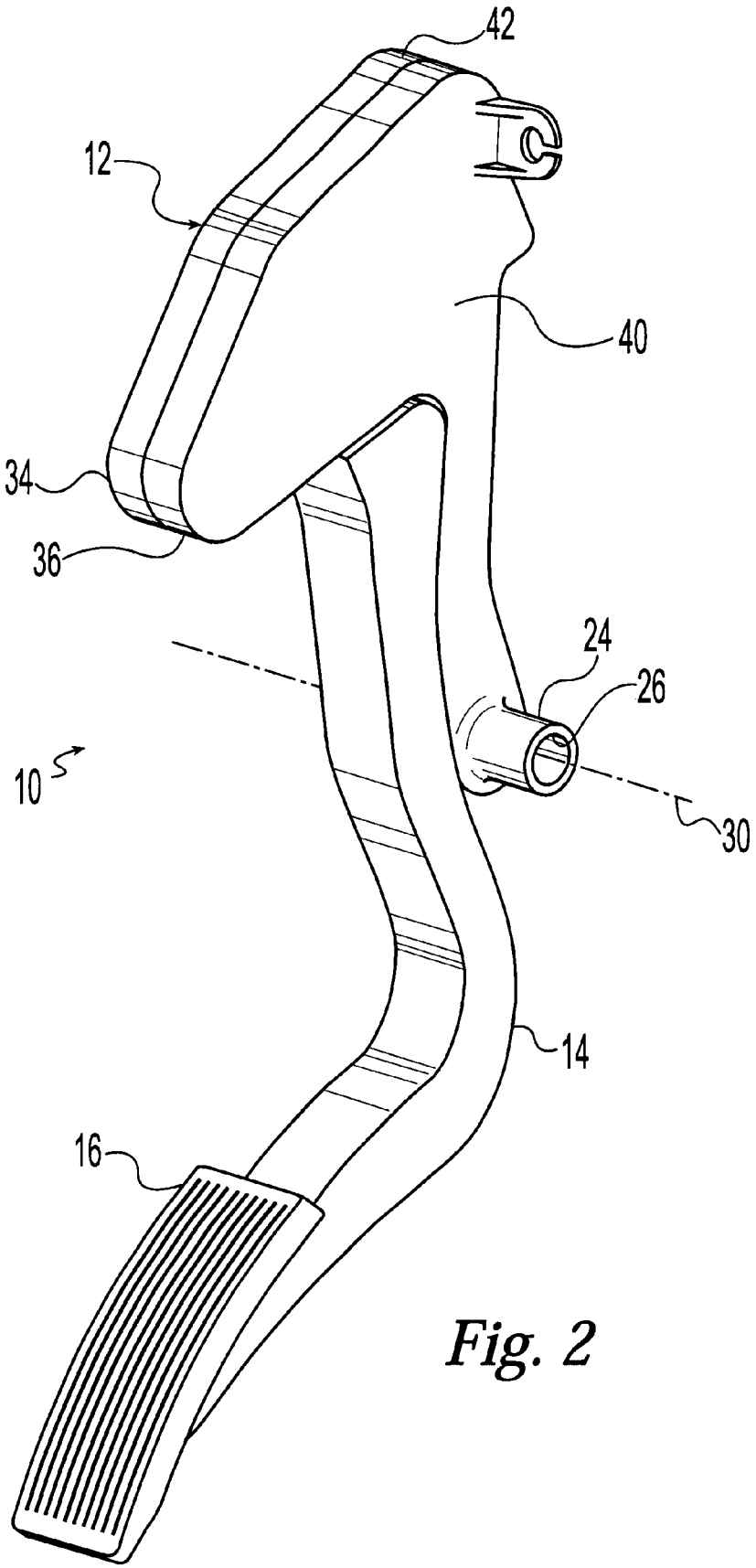
FIG. 2 is an enlarged perspective view of the adjustable control pedal assembly of FIG. 1.

The control pedal 10 includes an upper support or housing 12, a lower pedal arm 14 supported by the upper support 12 and carrying a pad or pedal 16 for engagement by the foot of the motor vehicle operator, and a drive assembly 18 for moving of the lower pedal arm 14 relative to the upper support 12 to adjust the forward/rearward position of the pedal 16. The upper support 12 is sized and shaped for pivotal attachment to a mounting bracket 20. The mounting bracket 20 is adapted to rigidly attach the adjustable control pedal 10 to a firewall or other rigid structure 22 of the motor vehicle. The upper support 12 is pivotably attached to the mounting bracket 20. The illustrated upper support 12 has a pair of oppositely facing hubs 24 having a laterally extending openings 26 (FIG. 2) extending therethrough for cooperation with the mounting bracket 20 and an axle or pivot pin 28. With the pivot pin 28 extending through the mounting bracket 20 and the openings 26 of the upper support 12, the upper support 12 is pivotable relative to the fixed mounting bracket 20 about a horizontally and laterally extending pivot axis 30 formed by the central axis of the pivot pin 28.

The upper support 12 is operatively connected to a control device such as an engine throttle so that pivotal movement of the upper support 12 about the pivot axis 30 operates the control device in a desired manner. The illustrated upper support 12 can be connected to the control device by a mechanical rod or cable 32 for mechanical actuation of the control device. It is noted however that the upper support 12 can alternatively be connected to the control device by a sensor and electrical wire, cable, or wireless connection for electronic actuation of the control device.

As best shown in FIGS. 2–5, the illustrated upper support 12 is formed by first and second support members 34, 36. The first and second support member 34, 36 are generally mirror images of one another except as noted hereinbelow and shown in the figures. The first and second support members 34, 36 are rigidly connected together to pivot together in unison. The first and second support members 34, 36 can be connected together by, for example, snap-fit connections, welding, staking, mechanical fasteners, or any other suitable manner. The first and second support members 34, 36 are preferably formed of a plastic such as NYLON but can alternatively be formed of any suitable material. The first and second members 34, 36 are preferably molded to reduce the number of required components.

The illustrated upper support 12 has a lower portion which generally extends upward from the pivot axis 30 and an upper portion which generally extends in a rearward direction from an upper end of the lower portion. The lower portion of upper support 12 is adapted for pivotal attachment to the mounting bracket 20 by way of the opposed hubs 24 as described hereinabove. The illustrated openings 26 are formed in the bottom of the lower portion but the openings 26 can have other suitable locations on the upper support 12 within the scope of the present invention.

The illustrated upper support 12 has a pair of substantially planer and laterally spaced-apart side walls 38, 40 which are connected by an end wall 42 which is generally perpendicular to the side walls 38, 40 and extends about the periphery of the side walls 38, 40. The first and second support members 34, 36 cooperate to form a hollow interior space or cavity 44 for receipt of an upper end of the lower pedal arm 14. An opening or slot 46 is formed in the end wall 42 at a bottom side of the interior space 44 for passage of the lower pedal arm 14 therethrough but the interior cavity is otherwise fully enclosed by the upper support 12. Within the interior space 44, the upper portion of the upper support 12 is adapted for supporting the lower pedal arm 14 and for selected fore and aft movement of the lower pedal arm 14 relative to the upper support 12 along the upper portion as described in more detail hereinafter. The illustrated first and second support members 34, 36 each have vertically spaced apart elongate upper and lower guides or flanges 48, 50 which generally extend in a forward/rearward direction along the length of the upper portion. The flanges 48, 50 inwardly extend from inner surfaces of the side walls 38, 40 of the first and second support members 34, 36 into the interior space 44. The illustrated flanges 48, 50 are sized and shaped to form upper and lower bearing surfaces 52, 54 (FIGS. 6 and 7) and cooperate with the lower pedal arm 14 for substantially linear forward/rearward movement of the pedal 16 relative the upper support 12 over a desired adjustment range, such as about three inches, as described in more detail hereinbelow. The illustrated flanges 48, 50 are each generally straight-sided ovals to form closed or blind slots, that is, slots only open on one lateral side. It is noted, however, that the flanges can have many other shapes within the scope of the present invention. Preferably, the lower flange 50 is offset rearward of the upper flange 48 and overlapping the upper flange 48. The flanges 48, 50 are preferably molded-in flanges so that they are a unitary portion of the upper support 12.

The lower pedal arm 14 is preferably formed of a suitable plastic such as NYLON but can alternatively be formed of other suitable materials. The illustrated lower pedal arm 14 is molded as a unitary elongate member with the pedal 16 at the lower end thereof. The pedal 16 is preferably molded-in to form a unitary portion of the lower pedal arm 14 but alternatively can be a separate component secured thereto. The pedal 16 is adapted for depression by the driver of the motor vehicle to pivot the control pedal 10 about the pivot axis 30 to obtain a desired control input to the control device of the motor vehicle. The upper end of the lower pedal arm 14 is adapted for movement relative to the upper pedal arm within the cavity and along the flanges 48, 50. The illustrated lower pedal arm 14 carries upper and lower guide pins or blocks 56, 58 laterally and horizontally extending therefrom to cooperate with the flanges 48, 50 of the first and second support members 34, 36 to form four sliding pin-and-slot connections for linearly moving the lower pedal arm 14 relative to the upper support 12. The guide pins 56, 58 are in sliding engagement with the bearing surfaces 52, 54 of the flanges such that the lower pedal arm 14 is supported by the upper support 12.

Figure 4:
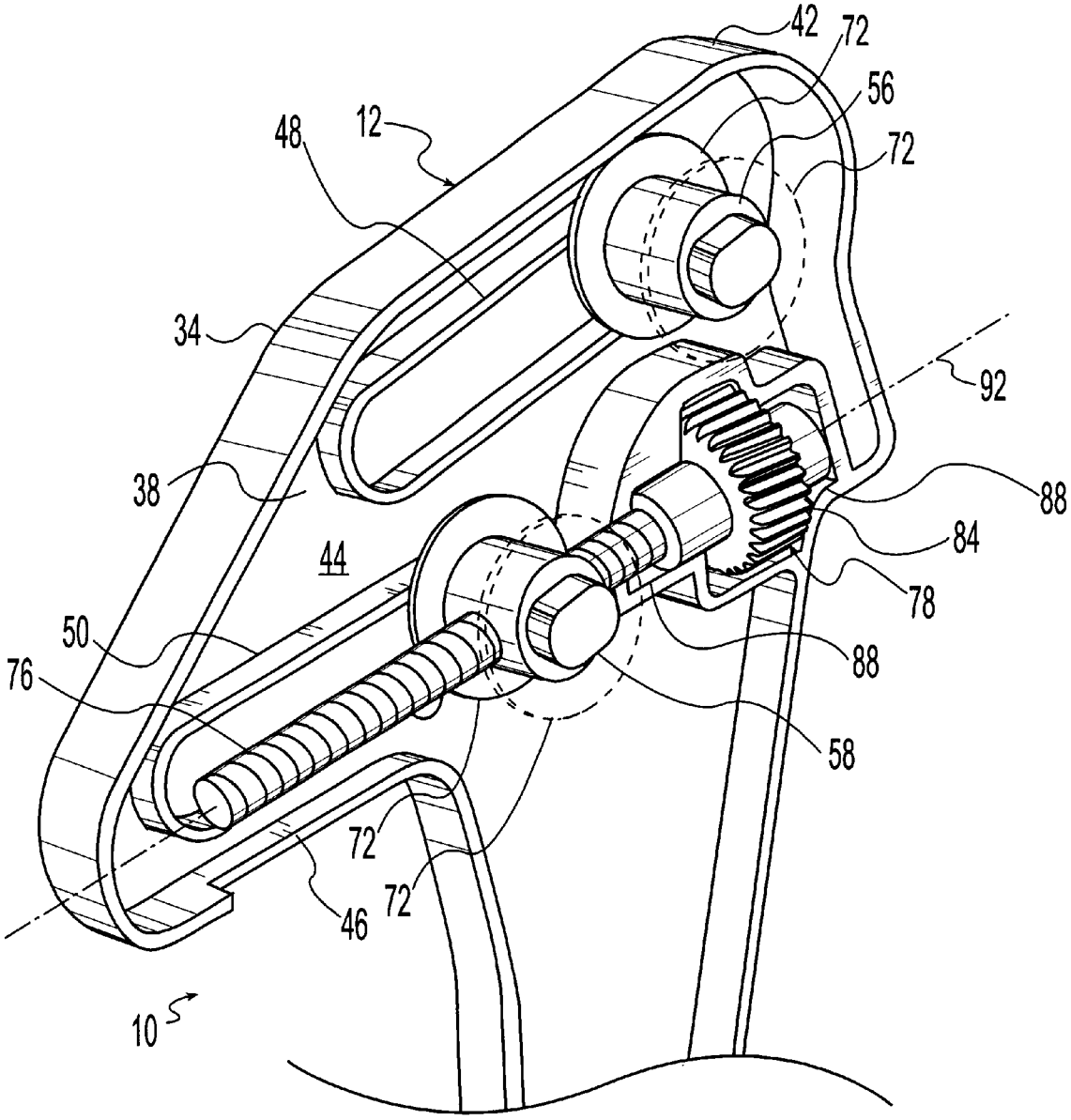
FIG. 4 is an enlarged perspective view of the upper end of the control pedal assembly of FIG. 3.
Figure 5:
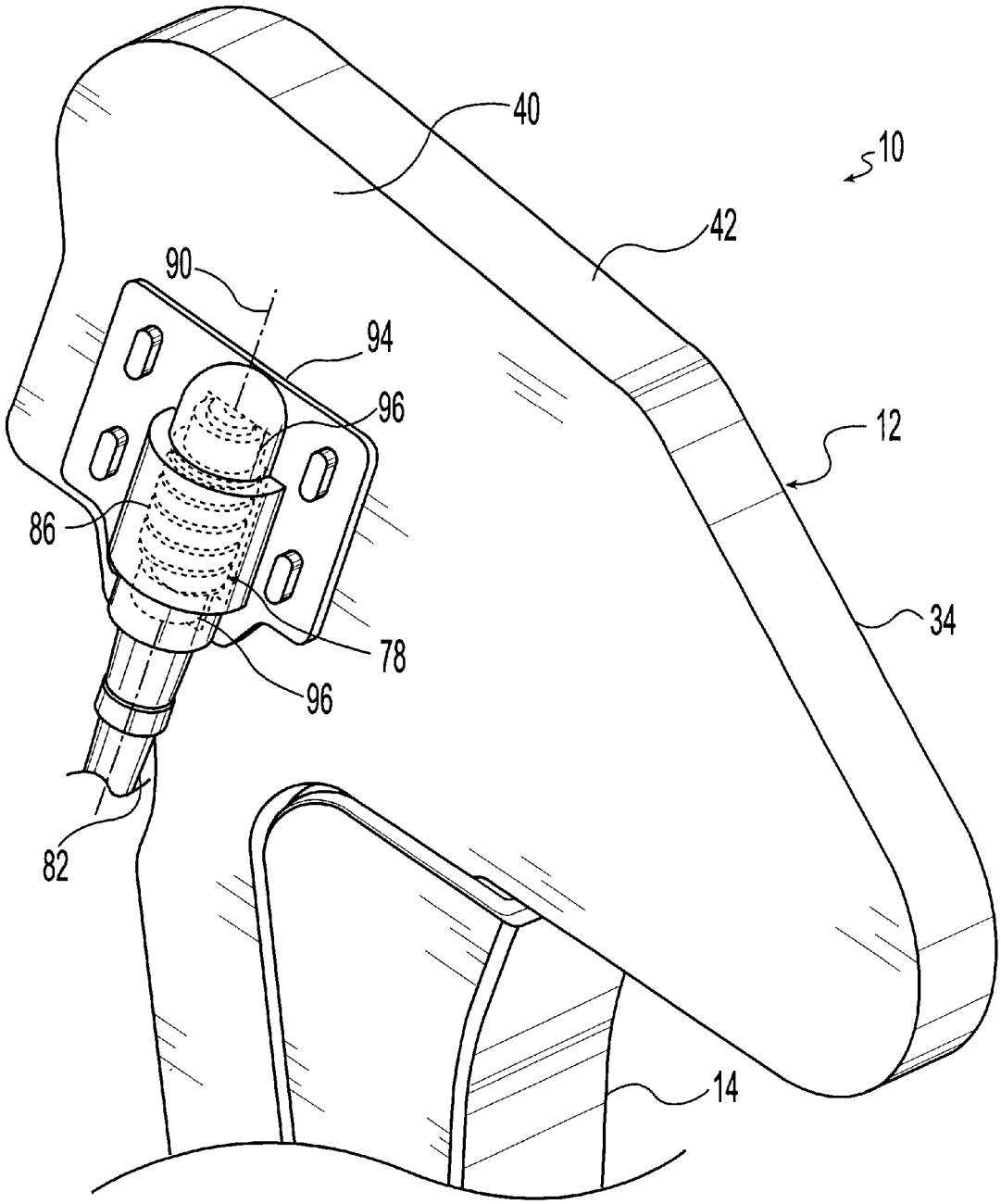
FIG. 5 is an perspective view of the upper end of the control pedal assembly similar to FIG. 4 but showing the opposite side.
Figure 6:
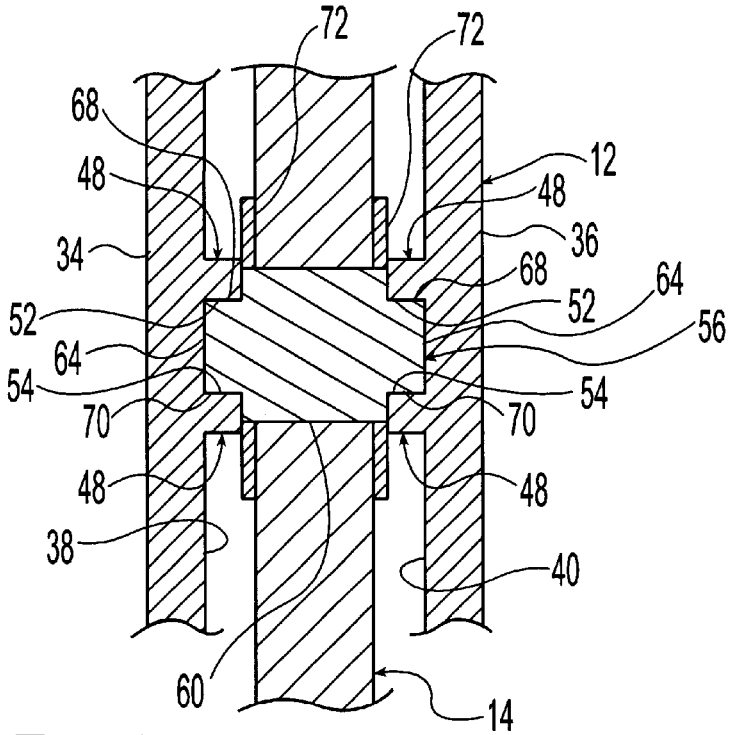
FIG. 6 is a cross-sectional view showing an upper guide pin of the control pedal assembly of FIGS. 1–5.

As best shown in FIGS. 4, 5, and 6, the illustrated guide pins 56, 58 each have a central portion 60 sized for cooperating with openings 62 in the lower pedal arm 14 and opposed end portions 64 sized for cooperating with the flanges 48, 50 in the first and second support members 34, 36 as described in more detail hereinafter. The illustrated central portion 60 is preferably sized to freely pivot or rotate relative to the lower pedal arm 14. When the upper and lower flanges 48, 50 are not parallel such as in the illustrated embodiment, the guide pins 56, 58 must pivot or rotate relative the flanges 48, 50 or within the openings 62 of the lower pedal arm 14. Because the illustrated embodiment of the guide pins 56, 58 has flat engagement surfaces, as described hereinbelow, the guide pins 56, 58 must pivot or rotate in the openings 62 of the lower pedal arm 14 because they cannot pivot or rotate relative to the flanges 48, 50. It is noted, however, that in other embodiments the guide pins 56, 58 can alternatively be rigidly secured to the lower pedal arm 14 or molded-in as unitary portions of the lower pedal arm 14. The upper guide pin 56 is preferably retained within the lower pedal arm 14 by engaging the flanges 48, 50 as described in more detail hereinafter.

The end portions 64 are preferably sized smaller than the central portion 60 to form outward facing abutments 66 which engage the flanges 48, 50. The end portions 64 are preferably provided with upper and lower engagement surfaces 68, 70 which are substantially flat or planar. The end portions 64 are sized and shaped so that there is very little or no vertical movement or "play" for the guide pins 56, 58 between the bearing surfaces 52, 54 of the flanges 48, 50. Washers 72 are preferably provided about ends of the guide pin central portions 60 which extend between the lower pedal arm 14 and the first and second support members 34, 36. The washers 72 are sized and shaped so that there is very little or no lateral movement or "play" for the lower pedal arm 14 between the flanges 48, 50 of the first and second support members 34, 36. The washers 72 re preferably formed of a suitable plastic or polymer material but can alternatively be any other type of suitable wear resistant and/or low friction material.

Figure 7:
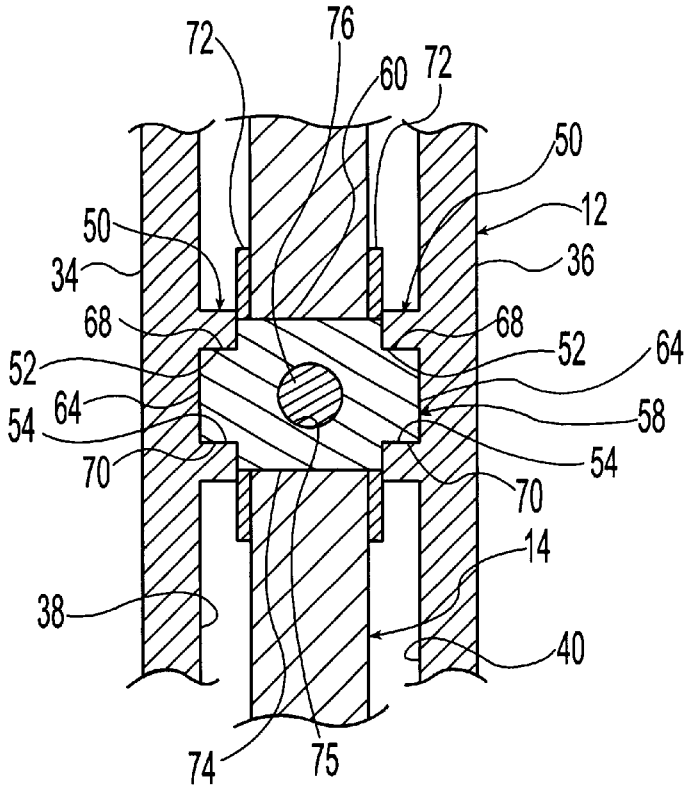
FIG. 7 is a cross sectional view showing a lower guide pin of the control pedal assembly of FIGS. 1–5.

As best shown in FIGS. 4 and 7, the illustrated lower guide pin 58 is substantially the same as the upper guide pin 56 except that the central portion 60 of the lower guide pin 58 forms a drive nut 74 of the drive assembly 18. The drive nut 74 includes a threaded opening 76 sized and shaped to cooperate with a drive screw 76 as discussed in more detail hereinafter. While the lower guide pin 58 of the illustrated embodiment forms the drive nut 74, it is understood that the upper guide pin 56 can alternatively form the drive nut 74 or the drive nut 74 can be attached to one of the guide pins 56, 58.

Figure 3:
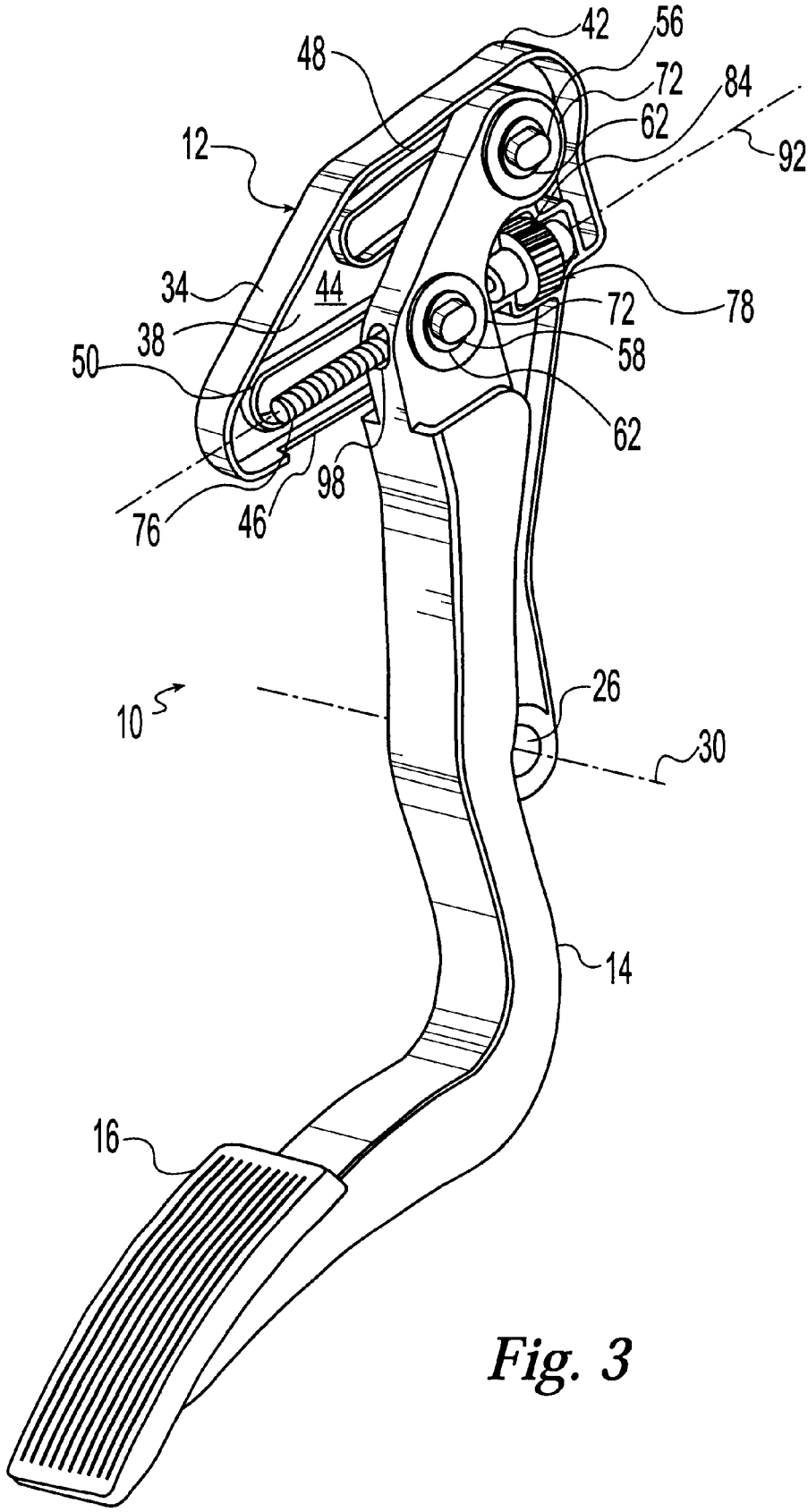
FIG. 3 is a perspective view of the adjustable control pedal assembly similar to FIG. 2 but with a portion of the housing assembly removed for clarity.

As best shown in FIGS. 3 and 4, the central axes of the upper and lower guide pins 56, 58 are preferably horizontally offset, that is, the axes of the upper and lower guide pins 56, 58 are preferably not in the same vertical plane to provide additional stability to the lower pedal arm 14. In the illustrated embodiment, the lower guide pin 58 is located rearward of the upper guide pin 56. The upper and lower guide pins 56, 58 are spaced apart along the length of lower pedal arm 14 a distance adequate to permit sliding of the guide pins 56, 58 along the flanges 48, 50. As best shown in FIGS. 6 and 7, the upper and lower guide pins 56, 58 extend onto the flanges 48, 50 of the first and second support members 34, 36 so that the lower pedal arm is supported by the first and second support members by contact of the upper and lower guide pins 56, 58 with the flanges 48, 50 and the lower pedal arm 14 is movable fore and aft relative to the first and second support members 34, 36 as the upper and lower guide pins 56, 58 slide along the flanges 48, 50. Each guide pin 56, 58 is in a double shear loading condition because the opposed end portions 64 are supported by the flanges 48, 50 of the first and second support members 34, 36 and loads are applied to the central portion 60 by the lower pedal arm 14. It is noted that the upper and lower guide pins 56, 58 can engage the flanges 48, 50 to provide mechanical limits to the movement of the lower pedal arm 14 relative to the upper support 12 or the drive assembly 18 can provide electronic or "soft" stops.

As best shown in FIGS. 1 to 5, the flanges 48, 50 are preferably sized and shaped such that, the pedal 16 moves along a substantially linear horizontal path as the guide pins 56, 58 travel along the flanges 48, 50. The illustrated flanges 48, 50 are angled downward in a rearward direction, that is the forward ends are located higher than the rearward ends. The illustrated flanges are also non-parallel, with the upper flange 48 at a steeper angle than the lower flange 50, to pivot the lower pedal arm 14 as the guide pins 56, 58 travel along the flanges 48, 50. As a result, the orientation of the pedal 16 somewhat changes as it moves along its substantially linear horizontal path. It should be appreciated that by utilizing inclined or angled flanges 48, 50 the package size of the control pedal 10 can be optimized for a particular motor vehicle and by pivoting the lower pedal arm 14 the pedal 16 can be moved along a horizontal linear path. Particularly, the length of the upper support 12 in the forward/rearward direction can be significantly reduced. This is particularly advantageous in compact or midsize motor vehicles having power steering because the available space for the control pedal 10 below the steering column is limited. It is noted, however, that the flanges 48, 50 can have other configurations such as, for example, horizontal and parallel so that the lower pedal arm 14 travels in a horizontal path and does not pivot, but there is an increase in the package size of the control pedal 10. It is also noted that in configurations where the lower pedal arm 14 pivots, it may be required in some configurations to have pivotable movement in the drive assembly 18 between the lower pedal arm 14 and the upper support 12 such as, for example, the lower guide pin 58 pivotable relative to the lower pedal arm 14, the drive nut 74 pivotable relative to the lower guide pin 58, and/or the drive screw 76 pivotable relative to the upper support 12.

The drive assembly 20 includes the screw shaft or drive screw 76, the drive nut 74 adapted for axial movement along the drive screw 76 in response to rotation of the drive screw 76, a gear mechanism 78 directly connected to the drive screw 76 for rotating the drive screw 76, an electric motor 80 connected to the gear mechanism 78, and a drive shaft or cable 82 operatively connecting the motor 80 to the gear mechanism 78 and transmitting rotation motion thereto from the electric motor 80. The drive screw 76 is an elongate shaft having a threaded portion adapted for cooperation with the drive nut 74. The drive screw 76 is preferably formed of plastic but can be alternately formed of any suitable material. The forward end of the illustrated drive screw 74 is secured directly to and supported by the gear mechanism 78.

The gear mechanism 78 includes a worm gear 84 and a worm 86. The worm gear 84 is coaxial with and connected to the drive screw 76 so that rotational motion of the worm gear 84 is transferred to the drive screw 76. The drive screw 76 rearwardly extends from the worm gear 84 generally parallel to and adjacent the lower flanges 50 of the first and second support members 34, 36 in a cantilevered fashion. Mounted in this manner, the drive screw 76 is generally horizontal. The first and second support members 34, 36 cooperate to form journals 88 to rotationally support the worm gear 84 for rotational movement of the worm gear 84 relative to the first and second support members 34, 36. The journals are preferably molded-in as unitary portions of the first and second support members 34, 36. The worm 86 is located laterally adjacent the worm gear 84 and is sized and shaped to cooperate with the worm gear 84 so that rotational motion of the worm 86 is transferred to the worm gear 84. A rotational axis 90 of the worm is generally vertical and substantially perpendicular to the rotational axis 92 of the worm gear 84 and the drive screw 76. The illustrated embodiment includes a gear mechanism cover 94 which cooperates with the first support member to generally enclose the worm 86. The cover 94 and the first support member 34 cooperate to form journals 96 to rotationally support the worm 86 for rotational movement of the worm 86 relative to the cover 94 and the first support member 34. The cover 94 is preferably formed of plastic but alternatively can be any suitable material. The illustrated cover 94 is attached to the first support member by snap-fit connections but can alternatively be attached in any suitable manner such as welding, staking, or mechanical fasteners.

The drive nut 74 is adapted for axial movement along the drive screw 76 in response to rotation of the drive screw 76. As discussed hereinabove, the drive nut 74 is preferably formed by the central portion 60 of the lower guide pin 58 but alternatively can be secured to the lower drive pin 58 or movement therewith. The upper end of the illustrated lower pedal arm 14 is provided with a clearance opening 98 therethrough so that the drive screw 76 can pass through the lower pedal arm 14 and engage the drive nut 74 therein The electric motor 80 can be of any suitable type and can be secured to the firewall 22 or other suitable location such as, for example, the mounting bracket 20. The drive cable 82 is preferably a flexible push-pull cable and connects the motor 80 and the lower end of the worm 86 so that rotation of the motor output shaft rotates the worm 86, the worm 86 rotates the worm gear 84, which rotates the drive screw 76. It is noted that the worm 86 and the motor 80 can be alternatively connected with a rigid connection. An input end of the drive cable 82 is connected to an output shaft of the motor 80 and an output end of the drive cable 82 is connected to an end of the worm 86. It is noted that the gears 84, 86 are sized to reduce the rotational motion from the motor 80 as necessary depending on the requirements of the control pedal 10. It is also noted that the fixed portion or sheath of the drive cable 82 is rigidly secured to the lower end of the cover 94 and a rotating portion of the cable 82 is operatively connected to the lower end of the worm 86 to rotate the worm 86 therewith.

Preferably, the drive assembly includes a controller including processing means and memory means are adapted to control operation of the motor 80. The controller can be a dedicated controller, the motor vehicle control unit, or a controller of another system of the motor vehicle such as, for example, a keyless entry system or a powered seat system. See U.S. patent application Ser. No. 09/492,636, the disclosure of which is expressly incorporated herein in its entirety by reference, for a more detailed description of a suitable control system having a controller.

To adjust the position of the control pedal 10, the operator engages a control switch which activates rotation of the motor 80 in the desired direction. Rotation of the motor output shaft rotates the worm 86 through the drive cable 82, the worm 86 rotates the worm gear 84, and rotation of the worm gear 84 rotates the drive screw 76. Rotation of the drive screw 76 causes the drive nut 74 to axially move along the drive screw 76 in the desired direction. The drive nut 74 moves along the drive screw because the drive nut 74 is held against rotation with the drive screw 76 by the lower guide pin 58 engaging the lower flanges 50. As the drive nut 74 axially moves along the drive screw 76, the lower guide pin 58 moves along the lower flanges 50. As the lower guide pin 58 slidingly moves along the lower flanges 50, the lower pedal arm 14 is moved therewith to adjust the forward/rearward position of the pedal 16. As the lower pedal arm 14 moves, the upper guide pin 56 slides along the upper guide flanges 48. With such movement, the pedal 16 travels in a substantially linear and horizontal path, that is, the pedal 16 moves in a forward/rearward direction and generally remains at the same height relative to the fixed mounting bracket 20 and the upper support 12 which does not move relative the mounting bracket 20 during adjustment of the pedal 16. The lower pedal arm 14 pivots as it moves so that the orientation of the pedal 16 slightly changes. This change in orientation of the pedal 16 is typically too small to be detected by the motor vehicle operator. As the position of the pedal 16 is adjusted by rotating the drive screw 76, the upper support 12 remains in fixed position relative to the mounting bracket 20. It can be seen from the above description that activation of the motor 80 changes the position of the lower pedal arm 14 relative to the upper support 12 and the position of the pedal 16 relative to the motor vehicle operator but not the position of the upper support 12 relative to the mounting bracket 20 and therefore does not affect the connection of the upper support 12 to the control device of the motor vehicle.

To actuate the control pedal 10, the operator depresses the pedal 16 with a foot to pivot both the lower pedal arm 14 and the upper support 12 together about the pivot axis 30. This pivotal movement of the control pedal 10, actuates the control device in a desired manner. When pressure is removed from the pedal 16, a return spring automatically pivots the lower pedal arm 14 and upper support 12 back to the unengaged position.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An adjustable control pedal comprising, in combination:

a mounting bracket;

an upper support forming a hollow interior space;

wherein the upper support is pivotably mounted to the mounting bracket;

a pedal arm having a lower end carrying a pedal;

wherein said pedal arm has an upper end extending into said interior space and supported by said upper support within said interior space for selected movement relative to said upper support;

wherein said interior space is enclosed by said upper support except for an opening at a bottom side of the upper support for passage of the pedal arm;

a drive assembly operatively connected to the pedal arm to selectively move the pedal arm relative to the upper support;

wherein said drive assembly includes a drive screw supported for rotational motion within the interior space of the upper support and a drive nut adapted for axial movement along the drive nut in response to rotational motion of the drive screw; and said drive nut is operatively connected to said pedal arm to axially move said pedal arm along said drive screw with said drive nut.

2. The adjustable control pedal according to claim 1, wherein said upper support is molded of plastic.

3. The adjustable control pedal according to claim 2, wherein said upper support includes unitary journals for supporting said drive screw.

4. The adjustable control pedal according to claim 1, wherein said drive assembly includes a gear mechanism located within the interior space of the upper support and connected to the drive screw.

5. The adjustable control pedal according to claim 4, wherein said upper support is molded of plastic and includes unitary journals for said gear mechanism.

6. The adjustable control pedal according to claim 1, wherein said upper support is provided with flanges within the interior space and the pedal arm is provided with at least one guide pin slidingly supported by the flanges to support the pedal arm for selected movement relative to said upper support.

7. The adjustable control pedal according to claim 6, wherein said upper support has a pair opposed side walls partially forming the interior space and the flanges inwardly extend into the interior space from the side walls on opposite sides of the interior space.

8. The adjustable control pedal according to claim 7, wherein said upper support is molded of plastic and said flanges are unitary with the upper support.

9. The adjustable control pedal according to claim 6, wherein said pedal arm is provided with two guide pins slidingly supported by the flanges to support the pedal arm for selected movement relative to said upper support and one of the guide pins forms the drive nut.

10. An adjustable control pedal comprising, in combination:

a mounting bracket;

an upper support forming a hollow interior space;

wherein the upper support is pivotably mounted to the mounted bracket;

wherein said upper support has a pair opposed side walls and an end wall extending between the side walls along at least the top, front and rear of the interior space and opposed flanges inwardly extending into the interior space from the side walls;

a pedal arm having a lower end carrying a pedal and an upper end provided with at least one guide pin slidingly supported by the opposed flanges for selected movement of the pedal arm relative to said upper support;

a drive assembly operatively connected to the pedal arm to selectively move the lower arm relative to the upper support;

wherein said drive assembly includes a drive screw supported for rotational motion within the interior space of the upper support and a drive nut adapted for axial movement along the drive screw within the interior space in response to rotational motion of the drive screw; and wherein said drive nut is operatively connected to said pedal arm to axially move said pedal arm along said drive screw with said drive nut.

11. The adjustable control pedal according to claim 10, wherein said upper support is molded of plastic.

12. The adjustable control pedal according to claim 11, wherein said upper support includes unitary journals for supporting said drive screw.

13. The adjustable control pedal according to claim 10, wherein said drive assembly includes a gear mechanism located within the interior space of the upper support and connected to the drive screw.

14. The adjustable control pedal according to claim 13, wherein said upper support is molded of plastic and includes unitary journals for said gear mechanism.

15. The adjustable control pedal according to claim 10, wherein said upper support is molded of plastic and said flanges are unitary with the upper support.

16. The adjustable control pedal according to claim 10, wherein said flanges are generally oval-shaped.

17. The adjustable control pedal according to claim 10, wherein said pedal arm is provided with two guide pins slidingly supported by the flanges to support the pedal arm for selected movement relative to said upper support and one of the guide pins forms the drive nut.

18. The adjustable control pedal according to claim 10, wherein said interior space is enclosed by said upper support except for an opening at a bottom side of the upper support and said upper end of the pedal arm extends into said interior space through said opening and is supported by said upper support within said interior space.

19. An adjustable control pedal comprising, in combination:

a mounting bracket;

a molded-plastic upper support forming a hollow interior space;

wherein the upper support is pivotably mounted to the mounting bracket;

wherein said upper support has a pair opposed side walls and an end wall extending between the side walls along at least the top, front and rear of the interior space and opposed flanges inwardly extending into the interior space from the side walls;

wherein said flanges are molded-in flanges unitary with the upper support;

a pedal arm having a lower end carrying a pedal and an upper end provided with at least one guide pin slidingly supported by the opposed flanges for selected movement of the pedal arm relative to said upper support;

a drive assembly operatively connected to the pedal arm to selectively move the lower arm relative to the upper support;

wherein said drive assembly includes a drive screw supported for rotational motion within the interior space of the upper support, a gear mechanism located within the interior space and operatively connected to the drive screw for rotating the drive screw, and a drive nut adapted for axial movement along the drive screw within the interior space in response to rotational motion of the drive screw;

wherein said upper support includes unitary molded-in journals supporting said gear mechanism; and wherein said drive nut is operatively connected to said pedal arm to axially move said pedal arm along said drive screw with said drive nut.

* * * * *